US007494279B2

(12) United States Patent
Marquet et al.

(10) Patent No.: US 7,494,279 B2
(45) Date of Patent: Feb. 24, 2009

(54) ERGONOMIC BAG ASSEMBLY FOR FOODS

(75) Inventors: Jean-Francois Marquet, Trainou (FR); Michel Colas, St. Jean le Blanc (FR)

(73) Assignee: Mars Incorporated, McLean, VA (US)

( * ) Notice: Subject to any disclaimer, the term of this patent is extended or adjusted under 35 U.S.C. 154(b) by 747 days.

(21) Appl. No.: 10/472,268

(22) PCT Filed: Mar. 15, 2002

(86) PCT No.: PCT/EP02/03765

§ 371 (c)(1),
(2), (4) Date: Mar. 17, 2004

(87) PCT Pub. No.: WO02/074646

PCT Pub. Date: Sep. 26, 2002

(65) Prior Publication Data

US 2004/0146223 A1 Jul. 29, 2004

(30) Foreign Application Priority Data

Mar. 20, 2001 (FR) ..... 01 03749

(51) Int. Cl.
*B65D 33/08* (2006.01)
*B65D 33/06* (2006.01)
*B65D 30/20* (2006.01)

(52) U.S. Cl. ..... 383/10; 383/17; 383/120

(58) Field of Classification Search ..... 383/6, 383/120, 10, 37, 16–17, 21
See application file for complete search history.

(56) References Cited

U.S. PATENT DOCUMENTS

| | | | | | |
|---|---|---|---|---|---|
| 25,826 | A | * | 10/1859 | Ward | 172/52 |
| 1,190,492 | A | * | 7/1916 | Way, Jr. | 383/10 |
| 3,089,635 | A | * | 5/1963 | Kugler | 383/9 |
| 3,339,824 | A | * | 9/1967 | Luke | 383/25 |
| 3,497,130 | A | * | 2/1970 | Stahl | 383/10 |
| 3,567,110 | A | * | 3/1971 | Susuki et al. | 383/10 |
| 4,243,171 | A | * | 1/1981 | Prin | 229/117.16 |
| 4,830,238 | A | * | 5/1989 | Widinski et al. | 224/572 |
| 4,925,438 | A | | 5/1990 | Wagner | |
| 5,529,394 | A | * | 6/1996 | Davoren | 383/204 |
| 5,611,626 | A | | 3/1997 | Warr | |
| 5,954,432 | A | * | 9/1999 | Laudenberg | 383/38 |
| 6,214,392 | B1 | * | 4/2001 | Ramirez | 426/106 |
| 6,361,209 | B1 | * | 3/2002 | LaRue et al. | 383/10 |

FOREIGN PATENT DOCUMENTS

| | | | |
|---|---|---|---|
| DE | 86 08 435.6 | | 7/1986 |
| DE | 88 08 159.1 | | 10/1988 |
| EP | 0 380 111 | | 8/1990 |
| FR | 2791040 | | 3/1999 |
| GB | 2171077 | A * | 8/1986 |
| WO | WO 00/40470 | | 7/2000 |

* cited by examiner

*Primary Examiner*—Jes F Pascua
(74) *Attorney, Agent, or Firm*—Fulbright & Jaworski L.L.P.

(57) ABSTRACT

The invention relates to a bag assembly for foods, in particular granular foods, including at least one bag which comprises two main walls joined by two side faces forming a gusset (S1, S2, S) along each side edge of the said main walls, and gripping means for the bag assembly, characterized in that the gripping means are implanted close to a side edge of each bag of the assembly.

12 Claims, 3 Drawing Sheets

ERGONOMIC BAG ASSEMBLY FOR FOODS

CROSS-REFERENCE TO RELATED APPLICATIONS

This application is a national stage filing of PCT/EP02/03765 filed Mar. 15, 2002, claiming priority to FR 01/03749 filed Mar. 20, 2001.

TECHNICAL FIELD

The present invention relates to food bags.

BACKGROUND OF THE INVENTION

In particular, it is advantageously used for bags for granular foods, such as dog or cat biscuits, for example.

Granular food bags made out of two main walls and two side faces are already known, these walls and faces being made of a flexible-sheet type material, the two main walls being assembled, at their two ends, the one on top of the other along two respective assembly lines, each assembly line being, for example, a weld or glue line, the two side faces, for their part, being shaped in the form of a gusset.

The walls and the side faces can be realised in any flexible material, for example with a base made of paper, flexible cardboard, plastic sheets or light metal. It is also possible to form laminated multilayered sheets using more than one of these materials.

FIGS. 1*a* to 1*c* represent diagrammatically the three main stages in the manufacture of an example of such a bag, according to the prior art.

In these figures, a sheet 10 realised in a flexible material is firstly doubled over along a median line L (FIG. 1*a*), such as to form the two main walls 11, 12 of the bag.

The line L is orientated in a direction corresponding to the direction which will be the direction of principal extension of the bag once this has been made.

The sheet 10 having thus been doubled over, the two main walls 11, 12 are joined together in such a way as to form a substantially cylindrical sleeve C (FIG. 1*b*). This "joining together" can be effected by any means which is known per se and is suited to the sheet material (welding, gluing . . . )

In the formation of this sleeve C, at the level of the side edges of the two walls 11 and 12 gussets S are formed by the arrangement of a fold line LS over all or part of the sleeve height (corresponding to the height of the bag) on each side of each main wall.

It is pointed out that, within the introduction of the present text, all terms of orientation ("below", "above", "upper", "lower", etc.) must be understood in relation to an arrangement in which the bag is held upright by being placed by its bottom on a horizontal surface, as represented in FIG. 1*c*.

The bag is then closed at the level of the lower and upper ends of the sleeve, for example by two weld lines L1 and L2. The bag is filled prior to the closure of the second of these lines.

A bag of simple design is thus obtained, made up of two main walls 11 and 12, the side edges of which are joined by gussets S.

It is also possible to form an equivalent bag in a different way, for example by fitting together a plurality of separate sheets.

The bags such as described above are extremely widely used to contain potentially runny foods, for example to contain animal foods (and, more especially, granular foods).

Bags of reduced dimensions (containing up to about six kilograms of product) generally appear as in FIG. 1*c*.

These bags are generally intended to be handled when they are in the upright position, corresponding to the representation shown in FIG. 1*c*. In this position, their direction of principal extension is vertical.

In the case of larger sized bags, it is necessary additionally to provide gripping means, such as handles which are added onto the bag. Such handles are fixed on the bag at its upper end.

A first drawback of this known configuration is that the bag must be handled in the upright position: the handling of the bag can then prove difficult, especially in the case of large-sized bags. Moreover, the stability of the vertically stored bag is not guaranteed.

And since extra material is needed to form such add-on handles, these give rise to an additional cost, which, in itself, constitutes another drawback.

Moreover, the addition of such handles onto the bag requires an extra stage to be realised in the bag manufacturing process.

The object of the invention is to propose a bag which enables the above mentioned drawbacks to be eliminated.

In order to achieve this object, the invention proposes a bag assembly for foods, in particular granular foods, including at least one bag which comprises two main walls joined by two side faces forming a gusset along each side edge of the said main walls, and gripping means for the bag assembly, characterised in that the gripping means are implanted close to a side edge of each bag of the assembly.

BRIEF SUMMARY OF THE INVENTION

Preferred, but non-limiting aspects of the bag assembly according to the invention are as follows:

the assembly only comprises one bag and one of the gussets S1 of the bag comprises a ridge comprising at least one opening forming a grip handle for the bag, the ridge is isolated in a seal-tight manner from the rest of the bag, the ridge comprises two leaves, each leaf containing an opening, the two openings being opposite one another so as to form a handle, at least one reinforcing element is connected to the part of the ridge surrounding the opening(s), at least two bags mutually joined by a gripping element comprising a handle the gripping element is a sheet element comprising two leaves, each of the leaves being fixed to one of the respective bags of the assembly.

it comprises at least two bags, each bag containing a gusset, one leaf of which has an increased height, the heightened leaves of two adjacent bags of the assembly being fixed together, a handle being arranged in the assembly formed by the said two heightened leaves in order to form gripping means for the bag assembly.

BRIEF DESCRIPTION OF THE DRAWINGS

Other aspects, objects and advantages of the invention will become clearer from a reading of the following description, in which.

DETAILED DESCRIPTION OF THE INVENTION

Figure 1C:
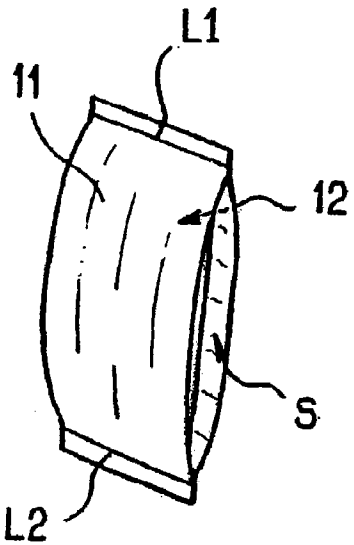
FIGS. 1*a* to 1*c* represent diagrammatically the three main stages in the manufacture of an example of such a bag, according to the prior art.
Figure 2:
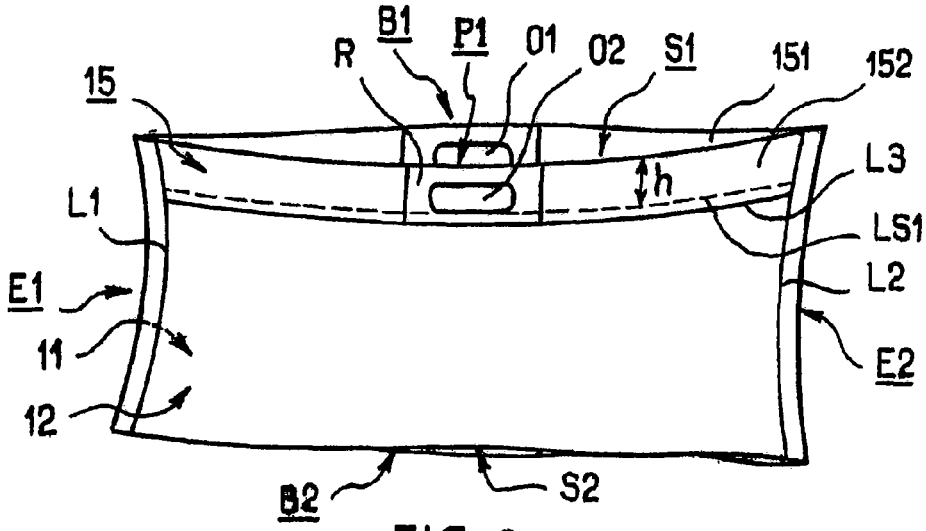
FIG. 2 is a diagrammatic representation in perspective view of a bag according to the invention.

With reference to FIG. 2, a bag of generally rectangular shape is represented lying down such that its direction of principal extension is parallel to the horizontal direction, in contrast to the traditional configuration of FIG. 1*c*.

This bag, like the known bags described above, comprises two main walls 11 and 12 of generally rectangular shape, joined by their side edges by two side faces, each of which forms a respective gusset S1, S2.

It is pointed out that the term "side edge" of a main wall (and, by extension, of the bag itself) here refers to one of the two edges of the rectangular main wall (or of the bag), the length of which is greater than that of the two adjacent edges, these two latter edges of shorter length being referred to by the term "end".

The bag thus contains two side edges B1, B2 and two ends E1, E2.

Returning to the two gussets of the bag, these comprise a first gusset S1, which in FIG. 2 is at the top of the recumbent bag, and a second gusset S2, which, unfolded, forms a base on which the bag rests.

Furthermore, the ends E1 and E2 of the bag are closed in a manner known per se by two lines L1 and L2, which can be realised by welding of the two respective ends.

As represented in FIG. 2, means are provided for gripping of the bag.

According to the invention, these gripping means are not disposed on (or close to) an end E1, E2 of the bag.

Rather, the gripping means, which are realised in a particular form to be described below, are disposed on a side edge, in this case the upper edge B1, such that they are situated equidistant from the two ends E1 and E2.

This implementation of the bag-gripping means in the middle of one of the side edges serves substantially to enhance the ergonomics associated with the bag.

In particular, the bag is easy to handle, the masses contained in the bag being much better balanced than in the known case of a bag equipped with gripping means placed at the end of the bag.

And in the case of a bag containing a loose product, such as granular foods, such reinforcement of the ergonomics is considerable. This is even truer in the case of a large-sized bag.

It will be noted that the lower gusset S2 is advantageously used as the base of the bag, in the unfolded position of the gusset. This helps further to increase the stability of the bag when it is placed in a position such as represented in FIG. 2.

According to another aspect of the invention, the gripping means are realised in the form of a handle made in a ridge 15 of the gusset S1, which ridge is isolated in a seal-tight manner from the rest of the bag by a weld line L3 joining the two main walls 11 and 12 over their entire length (a dimension which corresponded to the height in the case of known bags and which in FIG. 2 is parallel to the horizontal direction).

The ridge 15 is thus isolated from the rest of the bag and does not receive any product during the filling of the bag, which is carried out prior to the closure of the second of the lines L1, L2.

The ridge 15 comprises two leaves 151 and 152, separated by a fold line LS1 allowing the formation of the gusset S1.

The fold line LS1 can be situated above the weld line L3 (as represented in FIG. 2) or can coincide with it so as to form two leaves separated in a seal-tight manner.

In the event of the fold line LS1 being situated below the weld line L3, the said weld line does not directly join the two main walls 11 and 12 of the bag, but is actually replaced by two weld lines placed one opposite the other, each weld line joining the two walls of a respective leaf 151, 152.

In this case, the two weld lines also run over the entire length of each of the two leaves such as to isolate the leaves 151, 152 of the ridge from the rest of the bag in a seal-tight manner.

Still according to the invention, a respective opening O1, O2 has been arranged in each of the two leaves 151 and 152 of the ridge 15, the two openings being situated one opposite the other.

The two openings O1, O2 are preferably in the middle of the length of the side edge B1.

These two openings allow the engagement of the hand and thus form a handle P1 for a user.

The handle P1 thus formed constitutes a particularly simple and economical gripping means for the bag.

And, as previously mentioned, its implantation on one of the side edges of the bag allows the bag to be handled when extending in a generally horizontal direction, which is of particular use in the case of large-sized bags.

It will be possible to connect reinforcing elements R to the handle, for example in the form of reinforcement blocks glued or welded onto each leaf, around the opening made in the leaf.

And depending on the resistance of the material used to form the sheets of the bag, and hence the leaves 151 and 152 in which the handle P1 is arranged, such reinforcing elements may be able to be dispensed with.

Preferably, the height h of each leaf of the gusset S1 containing a handle is greater than or equal to the half-width of the said gusset S1 when this is opened out, such that the two leaves—and hence their respective openings O1, O2—can be easily brought together to form a handle and allow the bag to be handled.

According to a particularly preferred embodiment, the height h of each leaf is substantially equal to the width of the opened-out gusset.

In general terms, the height h of the leaves of the gusset S1 in which the handle is arranged will be able to be adapted to be greater than the height of the leaves of the gusset S2, which, for its part, is traditionally made.

An additional advantage of the invention is that it requires no modification of the customary bag-filling processes, the bag according to the invention being able to be filled in a traditional manner following the closure of a first of its ends and prior to the closure of its second end.

As will have been realised, such a bag is particularly (but not limitatively) suitable for the sale of granular animal foods.

Figure 3A:
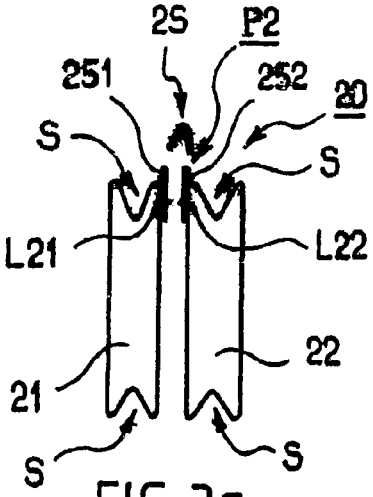
FIGS. 3*a* and 3*b* are respectively a transverse sectional view and a perspective view of a first embodiment of the invention, in which two bags are assembled in a same bag assembly.
Figure 3B:
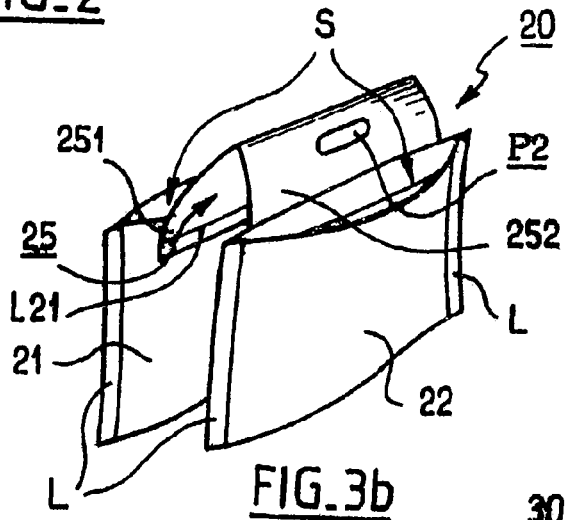

With reference now to FIGS. 3*a* and 3*b*, a variant of the invention has been represented in which a bag assembly 20 comprises two bags 21, 22.

It is pointed out that the representation shown in FIG. 3*a* corresponds to a transverse section made through the middle of the bag assembly, so that the handle P formed on the central gripping element 25 (which is to be described in detail below) appears as separating this element into a plurality of parts. The same is true of the representation shown in FIG. 4*a*.

Each of these two bags is a bag made up of two main walls, welded at their ends by weld lines L and the side edges of which are joined by gussets S.

Figure 1B:
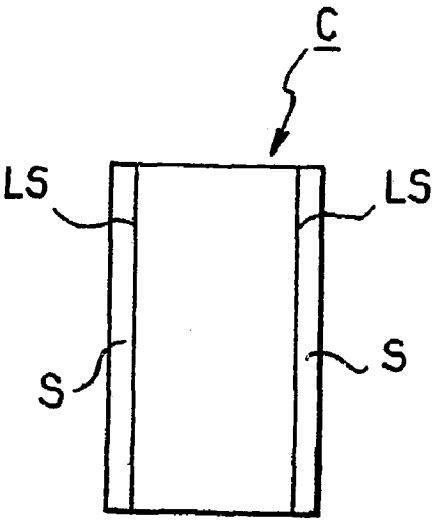
Figure 1A:
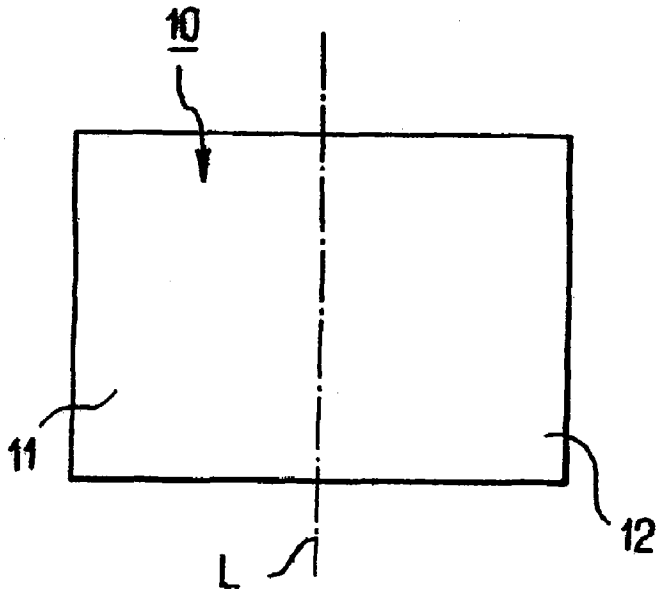

The two bags 21 and 22 can be realised in a manner which is known per se, in accordance with the description given in the introductory part of the present application with reference to FIGS. 1*a* to 1*c*.

According to this variant of the invention, gripping means are provided, implanted on the side edge of each bag, to allow handling of the bags in the same position as for the bag described with reference to FIG. 2, that is to say that their direction of greatest extension is orientated horizontally.

According to this variant of the invention, a central gripping element 25 is provided, composed of a sheet of flexible material doubled over so as to form two leaves 251 and 252.

Each of the two leaves is welded to one of the two respective bags by at least one respective weld line L21, L22 extending over a significant part of the length of the bag and preferably over the entire length of the leaf of the gripping element.

In order to ensure good cohesion of the assembly, the leaves of the gripping element are preferably of a length which covers a significant part of the length of each bag.

In the representation shown in FIG. 3*a*, the weld lines L21 and L22 thus join one of the leaves 251, 252 of the element 25 to the external wall of a gusset S of a respective bag 21, 22. These weld lines extend over the entire length of their associated leaf.

Each leaf 251, 252 of the gripping element 25 additionally contains an opening, the two openings being located one opposite the other such as to form a handle P2 for the gripping and handling of the bag assembly 20.

And here again, the handle P2 thus formed is preferably placed in the middle of the side edges of the two bags 21, 22.

It is pointed out that the weld lines L21 and L22 can be replaced by any means known per se for joining together the leaves 251, 252 and the bags 21, 22.

It is thus possible to replace these weld lines by glue lines, for example.

And it is also pointed out that the bag assembly, the principle of which has been described with reference to FIGS. 3*a* and 3*b*, can comprise more than two bags. In this case, the gripping element is adapted to comprise as many leaves as the number of bags contained in the bag assembly.

Figure 4A:
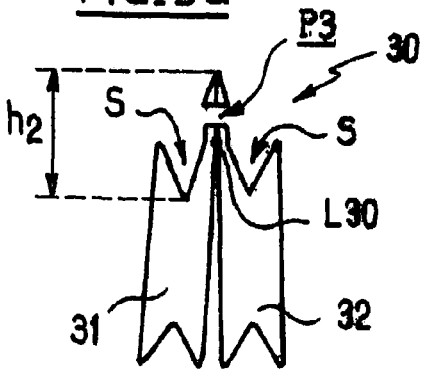
FIGS. 4*a* and 4*b* are respectively a transverse sectional view and a perspective view of a second embodiment of the invention, in which two bags are assembled in a same bag assembly.
Figure 4B:
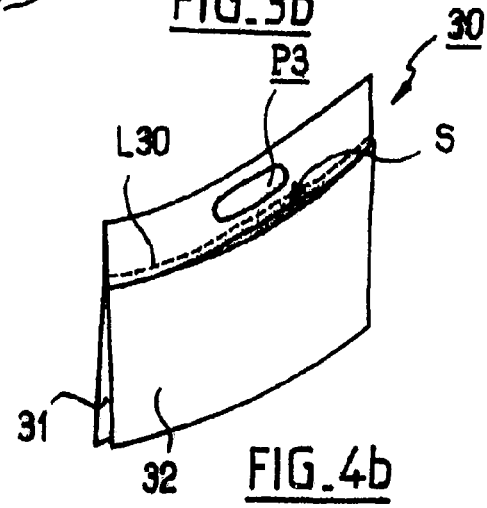
Figure 5:
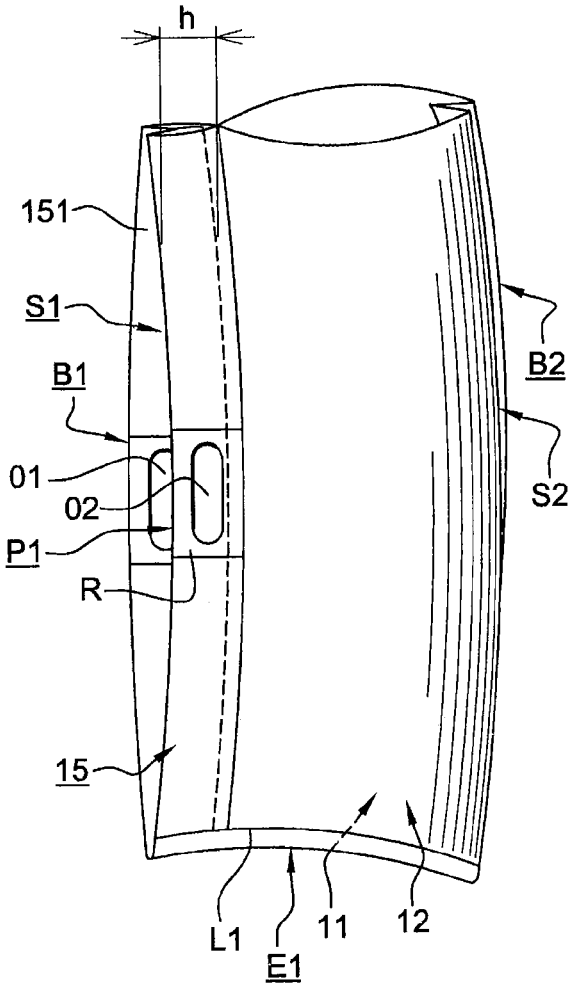
FIG. 5 is a representation of the bag FIG. 2 adapted to be filled via the second end following the closure of the first end and prior to the closure of the second end.
Figure 6:
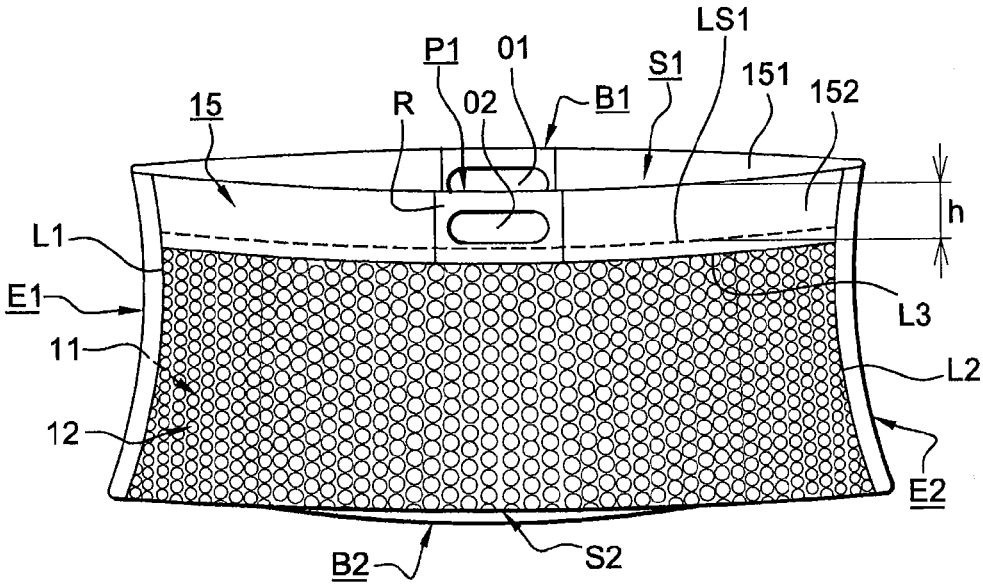
FIG. 6 is a "see through" representation of a bag assembly comprising granular animal food.

According to another variant of the invention represented in FIGS. 4*a* and 4*b*, it is also possible to form a bag assembly 30 containing two bags 31, 32, mutually joined together directly by a part of their edge gusset S which is above the bag (with the bags lying down such that their direction of greatest extension is horizontal).

In this case, one of the two leaves of each of these gussets can be envisaged having an increased height h2 such as to make it easier for these two leaves to be joined together and for an opening forming the handle P3 to be arranged in the gripping assembly thus formed by the two heightened leaves.

Here again, the joining together of the two bags 31, 32 can be realised by any means known to the person skilled in the art, such as one or more weld and/or glue lines.

In the example represented in FIGS. 4*a* and 4*b*, this joining together is effected by a weld line L30 made between the two external walls of the leaves of increased height h2 of the two respective bags 31, 32.

The weld line L30 thus runs over the entire length of these two gusset leaves (and hence over the entire length of the bags 31, 32). Still concerning this example, the weld line L30 is situated below the handle P3 of the bag assembly 30.

It is pointed out that if the diagrammatic representations shown in FIGS. 3*a* and 4*a* represent gussets S, the leaves of which are opened out wide and exhibit no internal weld intended to isolate the leaf from the rest of the contents of the bag, it is clearly possible to provide such weld lines to isolate, in the case of each of the leaves S represented in section in FIGS. 3*a* and 4*a*, each of the two leaves of the gusset, or at least the leaf located opposite the other bag which is used to form the means for gripping the bag assembly.

Finally, in this last embodiment of the invention once again, it is also possible to form a bag assembly comprising more than two bags.

In this variant, the bags of the assembly are disposed in series, the upper gusset S of each intermediate bag of the series having its two leaves of increased height h2, whereas the upper gusset S of each of the two end bags of the series can only contain a single leaf of increased height.

The heightened leaves of two adjacent bags of the series are in this case fixed together, for example by a weld line. And the handle P3 is in this case arranged in the assembly formed by the heightened leaves of the bags of the assembly.

The invention claimed is:

1. A bag assembly for foods comprising:

one bag; and gripping means for the bag assembly; wherein:

said bag comprises two main walls of generally rectangular shape, each of said main walls having two opposite side edges and two adjacent edges, the length of each of said side edges being greater than the length of each of said adjacent edges, said two opposite side edges corresponding each to a respective bag side edge, said two main walls being joined by two side faces forming a gusset along each of said side edges;

said gripping means are implanted close to one of said side edge of said bag;

said gripping means comprising at least one opening forming a grip handle for said bag, said at least one opening being arranged in a ridge of one of said gussets;

said ridge being isolated in a seal-tight manner from the rest of said bag by a weld line joining the two main walls over their entire length;

said bag being formed by doubling a sheet over, along a median line, to form said main walls which are joined together to form a substantially cylindrical sleeve, in the formation of which said two side faces forming a gusset are formed by arrangement of a fold line over all or part of the sleeve height; and said bag having a first end and a second end corresponding each to a respective one of said adjacent edges of said main walls, the bag being closed at the first end and the second end being open and adapted for filling said bag and for being closed after filling said bag.

2. The bag assembly according to claim 1, wherein said ridge comprises two leaves, each leaf containing an opening, the two openings being opposite one another to form said grip handle.

3. The bag assembly according to claim 1, wherein at least one reinforcing element is connected to a part of the ridge, said part of the ridge surrounding the at least one opening.

4. The bag assembly according to claim 1, wherein said bag is dimensioned for containing more than six kilograms of granular animal food.

5. The bag assembly according to claim 1, wherein said grip handle is arranged at the middle of the length of one of said bag side edges.

6. Bag assembly for foods comprising:

one bag; and gripping means for the bag assembly; wherein:

said bag comprises two main walls of generally rectangular shape, each of said main walls having two opposite side edges and two adjacent edges, the length of each of said side edges being greater than the length of each of said adjacent edges, said two opposite side edges corresponding each to a respective bag side edge, said two main walls being joined by two side faces forming a gusset along each of said side edges;

said gripping means are implanted close to one of said side edge of said bag;

said gripping means comprising at least one opening forming a grip handle for said bag, said at least one opening being arranged in a ridge of one of said gussets;

said ridge being isolated in a seal-tight manner from the rest of said bag by a weld line joining the two main walls over their entire length;

said ridge comprises two leaves, each leaf containing an opening, the two openings being opposite one another to form said grip handle;

said bag is formed by doubling a sheet over, along a median line, to form said main walls which are joined together to form a substantially cylindrical sleeve, in the formation of which said two side faces forming a gusset are formed by arrangement of a fold line over all or part of the sleeve height; and said bag has a first end and a second end corresponding each to a respective one of said adjacent edges of said main walls, the bag being closed at the first end and the second end being open and adapted for filling said bag and for being closed after filling said bag.

7. Bag assembly according to claim 6, wherein at least one reinforcing element is connected to a part of the ridge, said part of the ridge surrounding the at least one opening.

8. Bag assembly according to claim 6, wherein said bag is dimensioned for containing more than six kilograms of granular animal food.

9. Bag assembly according to claim 6, wherein said grip handle is arranged at the middle of the length of one of said bag side edges.

10. Bag assembly for foods comprising:

one bag; and gripping means for the bag assembly; wherein:

said bag comprises two main walls of generally rectangular shape, each of said main walls having two opposite side edges and two adjacent edges, the length of each of said side edges being greater than the length of each of said adjacent edges, said two opposite side edges corresponding each to a respective bag side edge, said two main walls being joined by two side faces forming a gusset along each of said side edges;

said gripping means are implanted close to one of said side edge of said bag;

said gripping means comprising at least one opening forming a grip handle for said bag, said at least one opening being arranged in a ridge of one of said gussets;

said ridge being isolated in a seal-tight manner from the rest of said bag by a weld line joining the two main walls over their entire length;

at least one reinforcing element is connected to a part of the ridge, said part of the ridge surrounding the at least one opening;

said bag is formed by doubling a sheet, over along a median line, to form said main walls which are joined together to form a substantially cylindrical sleeve, in the formation of which said two side faces forming a gusset are formed by arrangement of a fold line over all or part of the sleeve height; and said bag has a first end and a second end corresponding each to a respective one of said adjacent edges of said main walls, the bag being closed at the first end and the second end being open and adapted for filling said bag and for being closed after filling said bag.

11. Bag assembly according to claim 10, wherein said bag is dimensioned for containing more than six kilograms of granular animal food.

12. Bag assembly according to claim 10, wherein said grip handle is arranged at the middle of the length of one of said bag side edges.

* * * * *